US005278016A

United States Patent [19]

Fuller et al.

[11] Patent Number: 5,278,016

[45] Date of Patent: Jan. 11, 1994

[54] TONER COMPOSITION COMPRISING HALOGENATED SURFACE

[75] Inventors: Timothy J. Fuller, W. Henrietta; David H. Pan, Rochester; William M. Prest, Jr., Webster; Garland Jen, Oceanside, all of N.Y.; Michael K. Georges, Guelph, Canada

[73] Assignee: Xerox Corporation, Stamford, Conn.

[21] Appl. No.: 695,880

[22] Filed: May 6, 1991

[51] Int. Cl.[5] ..... G03G 9/08

[52] U.S. Cl. ..... 430/109; 430/108; 430/110; 430/138; 430/904

[58] Field of Search ..... 430/45, 109, 108, 110, 430/138, 904, 106, 126

[56] References Cited

U.S. PATENT DOCUMENTS

| | | | |
|---|---|---|---|
| 3,590,002 | 6/1971 | Powers | 252/182 |
| 4,529,680 | 7/1985 | Asanae et al. | 430/106.6 |
| 4,560,635 | 12/1985 | Hoffend et al. | 430/106.6 |
| 4,599,289 | 7/1986 | Svematsu et al. | 430/98 |
| 4,883,736 | 11/1989 | Hoffend et al. | 430/110 |
| 4,902,597 | 2/1990 | Takeda et al. | 430/106.6 |
| 4,935,326 | 6/1990 | Creatura et al. | 430/108 |
| 4,937,166 | 6/1990 | Creatura et al. | 430/108 |
| 4,952,477 | 8/1990 | Fuller et al. | 430/109 |
| 4,957,844 | 9/1990 | Page | 430/115 |
| 4,965,172 | 10/1990 | Matrick | 430/291 |
| 4,971,880 | 11/1990 | Hotomi et al. | 430/108 |
| 4,981,911 | 1/1991 | Herrmann et al. | 525/258 |
| 5,053,459 | 10/1991 | Herrman et al. | 525/99 |

FOREIGN PATENT DOCUMENTS

| | | |
|---|---|---|
| 58-205165 | 11/1983 | Japan . |
| 58-207053 | 12/1983 | Japan . |
| 61-118758 | 6/1986 | Japan . |
| 2-077755 | 3/1990 | Japan . |

*Primary Examiner*—Marion E. McCamish
*Assistant Examiner*—Rosemary Ashton
*Attorney, Agent, or Firm*—E. O. Palazzo

[57] ABSTRACT

A toner composition comprised of resin particles and pigment particles, and wherein the toner is surface treated with a halogen.

40 Claims, 1 Drawing Sheet

TONER COMPOSITION COMPRISING HALOGENATED SURFACE

BACKGROUND OF THE INVENTION

This invention is generally directed to toner compositions, and more specifically, the present invention relates to developer compositions with toner compositions comprised of low melt resin particles. In one embodiment, the present invention relates to an encapsulated toner generated when a toner comprised of resin particles, colorants, such as known pigment particles, and optional additives, such as known charge control components, is subjected to halogenation, especially chlorination. An encapsulated toner comprised of a major amount of resin particles, which are usually low melting as illustrated herein, of the present invention can be prepared by chemically treating the surfaces of preformed toner particles to form higher melting protective skins resembling shells on the surfaces of the toner. More specifically, in one embodiment of the present invention there are provided developer compositions formulated by, for example, admixing low melting, about 220° F. to about 300° F., toner compositions following treatment with a halogen and carrier components. In one embodiment of the present invention there are provided toner compositions with low melting toner resins containing polymers prepared by bulk, solution, free radical, anionic, suspension, dispersion, or emulsion techniques, such as $(A—B)_n$ wherein n represents the number of repeating polymer segments and where A and B represent monomeric or oligomeric segments of, for example, styrene and butadiene, respectively, which components possess in an embodiment of the present invention a desirable low fusion and low fusing energy; are easily jettable or processable into toner compositions; enable low temperature fusing; are optically clear; allow matte and gloss finishes; and with the toner resins illustrated herein there can in embodiments be fabricated brittle, rubbery, or other similar toner polymers with an optimized melt viscosity profile, and a lowering of the fusing temperature characteristics of the toner resin can be achieved. The toner polymers of the present invention can be processable by conventional toner means, that is these materials are extrudable, melt mixable and jettable. In another embodiment of the present invention toner particles generated by known in situ particle formation methods, such as dispersion polymerization with colorant, can be treated with a halogen, especially chlorine, to form encapsulated toners with nonblocking and low melting characteristics. Nonblocking ultra low melt toners of the present invention in embodiments can be prepared by the surface treatment thereof with halogen to form a protective halopolymer shell. The surface treatment method in an embodiment can be selected for toner particles comprised of unsaturated polymers that form covalent reaction products with halogens. The resulting toner materials in an embodiment of the present invention possess excellent triboelectric charging characteristics and also can fuse and fix to paper at about 50° to 100° F. lower than conventional known toners with polymers such as styrene methacrylates. Toner compositions formulated with the aforementioned ultra low melt toner resins have a number of advantages as illustrated herein. Thus, for example, the toner compositions in an embodiment of the present invention possess lower fusing temperatures, and therefore lower fusing energies are required for fixing, thus enabling less power consumption during fusing, and permitting extended lifetimes for the fuser systems selected. Moreover, high gloss images may be obtained at lower fuser set temperatures. The toners of the present invention can be fused (fuser roll set temperature) at temperatures of between 220° and 320° F. in embodiments of the present invention as compared to a number of currently commercially available toners which fuse at temperatures of from about 300° to about 370° F. With further respect to the present invention, the ultra low melt resins have, for example, in embodiments thereof a glass transition temperature of from about 24° to about 72° C. and in embodiments employing cryogenic jetting conditions, glass transition temperatures of from about 0° or less to about 24° C. Known nonblocking characteristics, that is noncaking or retaining substantially all the properties of a free flowing powder at temperatures of, for example, about 120° F. or less are obtained with the toner compositions of the present invention in embodiments thereof. In an embodiment, the encapsulated ultra low melt resin particles of the present invention have a number average molecular weight of from about 3,000 to about 100,000 and preferably from about 6,000 to about 50,000. Also, the economical toner and developer (toner+carrier) compositions of the present invention are particularly useful in electrophotographic imaging and printing systems, including color, especially xerographic imaging processes that are designed for the generation of full color images. Both matte and gloss images may be achieved according to the resin fusing conditions selected. Further, the treated toner compositions of the present invention can be selected for single component development in that, for example, the toners resist smearing, and do not form toner aggregates under the pressure stresses usually selected for such development systems.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Of known value with respect to the aforementioned developer compositions, for example, is the appropriate triboelectric charging values associated therewith as it is these values that can enable continued constant developed images of high quality and excellent resolution and admixing characteristics. Specifically, thus toner and developer compositions are known, wherein there are selected as the toner resin styrene acrylates, styrene methacrylates, and certain styrene butadienes including those available as PLIOTONES®. Other resins have also been selected for incorporation into toner compositions inclusive of the polyesters as illustrated in U.S. Pat. No. 3,590,000. Moreover, it is known that single component magnetic toners can be formulated with styrene butadiene resins, particularly those resins available as PLIOLITE®. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyl dimethyl ammonium methyl sulfate charge enhancing additives. The '635 patent also illustrates the utilization of suspension polymerized styrene butadienes for incorporation into toner compositions, reference for example working Example IX.

In a patentability search report, the following two United States patents were listed:

U.S. Pat. No. 4,971,880; Patentee: Hotomi et al.; Issued: Nov. 20, 1990.

U.S. Pat. No. 4,902,597; Patentee: Takeda et al.; Issued: Feb. 20, 1990.

U.S. Pat. No. 4,971,880 to Hotomi et al., assigned to Minolta, discloses a developer containing halogenated carbon particles prepared by plasma polymerization. A binder resin may comprise a styrene butadiene copolymer.

U.S. Pat. No. 4,902,597 to Takeda et al., assigned to Fuji Xerox, discloses a developer comprising a binder resin such as a styrene butadiene copolymer into which a fluorine-containing resin such as tetrafluoroethylene is incorporated.

Numerous patents are in existence that illustrate toner compositions with various types of toner resins including, for example, U.S. Pat. Nos. 4,104,066, polycaprolactones; 3,547,822, polyesters; 4,049,447, polyesters; 4,007,293, polyvinyl pyridine-polyurethane; 3,967,962, polyhexamethylene sebaccate; 4,314,931, polymethyl methacrylates; U.S. Pat. No. Re. 25,136, polystyrenes; and U.S. Pat. No. 4,469,770, styrene butadienes.

In U.S. Pat. No. 4,529,680, there are disclosed magnetic toners for pressure fixation containing methyl-1-pentene as the main component. More specifically, there are illustrated in this patent, reference column 2, beginning at line 66, magnetic toners with polymers containing essentially methyl-1-pentene as the main component, which polymer may be a homopolymer or copolymer with other alpha-olefin components. It is also indicated in column 3, beginning at around line 14, that the intrinsic viscosity of the polymer is of a specific range, and further that the melting point of the polymer is in a range of 150° to 240° C., and preferably 180° to 230° C. Other patents that may be of background interest include U.S. Pat. Nos. 3,720,617; 3,752,666; 3,788,994; 3,983,045; 4,051,077; 4,108,653; 4,258,116 and 4,558,108.

In addition, several patents illustrate toner resins including vinyl polymers, diolefins, and the like, reference for example U.S. Pat. No. 4,560,635. Moreover, there are illustrated in U.S. Pat. No. 4,469,770 toner and developer compositions wherein there are incorporated into the toner styrene butadiene resins prepared by emulsion polymerization processes.

Furthermore, a number of different carrier particles have been illustrated in the prior art, reference for example the U.S. Pat. No. 3,590,000 mentioned herein; and U.S. Pat. No. 4,233,387, the disclosures of which are totally incorporated herein by reference, wherein coated carrier components for developer mixtures, which are comprised of finely divided toner particles clinging to the surface of the carrier particles, are recited. Specifically, there are disclosed coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. More specifically, there are illustrated in the '387 patent processes for the preparation of carrier particles by a powder coating process, and wherein the carrier particles consist of a core with a coating thereover comprised of polymers. The carrier particles selected can be prepared by mixing low density porous magnetic, or magnetically attractable metal core carrier particles with from, for example, between about 0.05 percent and about 3 percent by weight based on the weight of the coated carrier particles of a polymer until adherence thereof to the carrier core by mechanical impaction or electrostatic attraction; heating the mixture of carrier core particles and polymer to a temperature, for example, of between from about 200° F. to about 550° F. for a period of from about 10 minutes to about 60 minutes enabling the polymer to melt and fuse to the carrier core particles; cooling the coated carrier particles; and thereafter classifying the obtained carrier particles to a desired particle size. In U.S. Pat. Nos. 4,937,166 , and 4,935,326, the disclosures of which are totally incorporated herein by reference, there are illustrated, for example, carrier particles comprised of a core with a coating thereover comprised of a mixture of a first dry polymer component and a second dry polymer component not in close proximity to the first polymer in the triboelectric series. Therefore, the aforementioned carrier compositions can be comprised of known core materials including iron with a dry polymer coating mixture thereover. Subsequently, developer compositions can be generated by admixing the aforementioned carrier particles with a toner composition comprised of resin particles and pigment particles. Other patents include U.S. Pat. No. 3,939,086, which teaches steel carrier beads with polyethylene coatings, see column 6; U.S. Pat. Nos. 3,533,835; 3,658,500; 3,798,167; 3,918,968; 3,922,382; 4,238,558; 4,310,611; 4,397,935 and 4,434,220.

In copending application U.S. Ser. No. 751,922, now abandoned, entitled Developer Compositions With Specific Carrier Particle Developers, the disclosure of which is totally incorporated herein by reference, there are illustrated toners with styrene butadiene copolymers, pigment particles inclusive of magnetites, charge control additives, and carrier particles containing a core with a coating thereover of vinyl copolymers, or homopolymers, such as vinyl chloride/vinyl acetate.

Semicrystalline polyolefin resins or blends thereof are illustrated in U.S. Pat. Nos. 4,990,424 and 4,952,477, the disclosures of which are totally incorporated herein by reference. More specifically, in U.S. Pat. No. 4,952,477 there are disclosed toners with semicrystalline polyolefin polymer or polymers with a melting point of from about 50° to about 100° C., and preferably from about 60° to about 80° C. with the following formulas wherein x is a number of from about 250 to about 21,000; the number average molecular weight is from about 17,500 to about 1,500,000 as determined by GPC; and the $M_w/M_n$ dispersity ratio is from about 2 to about 15.

I. Polypentenes—$(C_5H_{10})_x$
II. Polytetradecenes—$(C_{14}H_{28})_x$
III. Polypentadecenes—$(C_{15}H_{30})_x$
IV. Polyhexadecenes—$(C_{16}H_{32})_x$
V. Polyheptadecenes—$(C_{17}H_{34})_x$
VI. Polyoctadecenes—$(C_{18}H_{36})_x$
VII. Polynonadecenes—$(C_{19}H_{38})_x$; and
VIII. Polyeicosenes—$(C_{20}H_{40})_x$.

Examples of specific semicrystalline polyolefin polymers illustrated in this copending application include poly-1-pentene; poly-1-tetradecene; poly-1-pentadecene; poly-1-hexadecene; poly-1-heptadecene; poly-1-octadene; poly-1-nonadecene; poly-1-eicosene; mixtures thereof; and the like. These materials are particularly suitable for making matte or low gloss black copies and prints.

Although the above described toner compositions and resins are suitable for their intended purposes, especially those of U.S. Pat. Nos. 4,952,477 and 4,990,424 now U.S. Pat. No. 4,790,424 in most instances, there continues to be a need for toner and developer compositions containing new resins. More specifically, there is a need for toners which can be fused at lower energies than many of the presently available selected toners but which retain many or all of the same desirable physical properties, for example, hardness, processibility, clarity, high gloss durability, and the like. There is also a need for resins that can be selected for toner compositions which are low cost, nontoxic, nonblocking at temperatures of less than 50° C., jettable, melt fusible with a broad fusing latitude, cohesive above the melting temperature, and triboelectrically chargeable. In addition, there remains a need for toner compositions, especially low melt toners, which can be fused at low temperatures, that is for example 260° F. or less, as compared to a number of toners presently in commercial use, which require fusing temperatures of about 300° to 325° F., thereby enabling with the compositions of the present invention the utilization of lower fusing temperatures, and lower fusing energies permitting less power consumption during fusing, and allowing the fuser system, particularly the fuser roll selected, to possess extended lifetimes. There is also a need for toners which provide high gloss for pictorial color image quality. Another need resides in the provision of developer compositions comprised of the toner compositions illustrated herein, and carrier particles. Moreover, there is a need for low melting toner compositions which do not smear, or wherein smearing is minimized, and agglomeration is substantially avoided in single and two component development systems, especially single component development housings. There also remains a need for toner and developer compositions containing additives therein, for example charge enhancing components, thereby providing positively or negatively charged toner compositions. There is also a need for low melting toners which do not agglomerate, cake or block especially under ambient atmosphere and machine operating conditions. There is also a need for colored toners with passivated surfaces to assist in controlling the triboelectric properties thereof. Furthermore, there is a need for toner and developer compositions with ultra low melt resin polymers that will enable the generation of solid image areas with substantially no background deposits, and full gray scale production of half tone images in electrophotographic imaging and printing systems.

There is also a need for ultra low melt resin nonblocking toners with glass transition temperatures of, for example, from about 24° to about 110° C., and preferably from about 33° to about 60° C.; and wherein the toner compositions can be formulated into stable developer compositions which are useful in single and two component electrophotographic imaging and printing systems, and wherein fusing can, for example, be accomplished by flash, radiant, with heated ovens, cold pressure, and heated roller fixing methods in embodiments of the present invention.

There is also a need for toners with low glass transition temperature cores with glass transition temperatures of, for example, from about 24° to about 110° C. and preferably from about 33° to about 60° C. encapsulated with higher glass transition temperature polymer shells. Shell polymer glass transition temperatures may range from about 24° to about 110° C. and preferably these temperatures are greater than 55° C.

SUMMARY OF THE INVENTION

It is a feature of the present invention to provide toner and developer compositions which possess many of the advantages illustrated herein.

In another feature of the present invention there are provided developer compositions with positively charged toners containing therein low melt resins.

Also, in another feature of the present invention there are provided toner compositions containing therein ultra low melt polymers as resinous components, which when formulated into encapsulated ultra low melt toner particles by surface halogenation have core (resin, pigment, and optional additives when selected) glass transition temperatures of from about 20° to about 75° C., and preferably from about 33° to about 60° C., and shell glass transition temperatures of from about greater than 55° C., and do not block or cake together at temperatures of, for example, near 120° F.

Further, in an additional feature of the present invention there are provided developer compositions comprised of toner particles having incorporated therein ultra low melt resins, and carrier particles.

Furthermore, in another feature of the present invention there are provided improved toner compositions which can be fused at low temperatures thereby reducing the amount of energy needed for affecting fusing of the image developed.

Moreover, in another feature of the present invention there are provided developers with positively or negatively charged toner compositions that possess excellent electrical properties.

Also, in another feature of the present invention there are provided developers with stable triboelectric charging characteristics for extended time periods exceeding, for example, 1,000,000 imaging cycles.

Another feature of the present invention resides in the provision of toner compositions with excellent blocking temperatures, and acceptable fusing temperature latitudes.

In another feature of the present invention there are provided toner and developer compositions that are nontoxic, nonblocking at temperatures of less than 50° F., jettable, melt fusible with a broad fusing latitude, and cohesive above the melting temperature thereof.

Furthermore, in an additional feature of the present invention there are provided developer compositions containing carrier particles with a coating thereover comprised of a mixture of polymers that are not in close proximity in the triboelectric series, reference U.S. Pat. Nos. 4,937,166, and 4,935,326, the disclosures of which are totally incorporated herein by reference.

In another feature of the present invention there are provided methods for preparing encapsulated ultra low melt toner particles from ultra low melt resin particles with high gloss pictorial quality color images.

Also, in yet still another feature of the present invention there are provided methods for the development of electrostatic latent images with toner compositions containing therein ultra low melt polymers as resin particles.

In yet another feature of the present invention there are provided developer compositions with carrier components obtained by a dry coating process, which particles possess substantially constant conductivity parameters, and a wide range of preselected triboelectric charging values.

Furthermore, in yet a further feature of the present invention there are provided developer compositions with carrier particles comprised of a coating with a mixture of polymers that are not in close proximity, that is for example a mixture of polymers from different positions in the triboelectric series, and wherein the toner compositions incorporated therein possess excellent admix charging values of, for example, less than one minute, and triboelectric charges thereon of from about positive or negative 10 to about 40 microcoulombs per gram.

Another feature of the present invention resides in the provision of toner and developer compositions which are insensitive to humidity of from about 20 to about 90 percent, and which compositions possess superior aging characteristics enabling their utilization for a substantial number of imaging cycles, exceeding 500,000 in some embodiments, with very little modification of the triboelectrical properties, and other characteristics.

Also, in another feature of the present invention there are provided ultra low melting toner compositions.

In still another feature of the present invention there are provided toner and developer compositions for affecting development of images in electrophotographic imaging apparatus, including xerographic imaging and printing processes.

In another feature of the present invention there can be provided halogenated toner compositions and developer compositions wherein the toner contains additive components, such as UNILINS®, reference U.S. Pat. No. 4,883,736, the disclosure of which is totally incorporated herein by reference, microcrystalline waxes, semicrystalline components, and the like to enable, for example, the effective molten toner release from fuser rolls, and for improved fusing lattitudes with low amounts of release fluids, such as silicone oils.

Still another feature of the present invention is to provide toner polymers which pass blocking test requirements above the glass transition temperature of the toner particle polymer core.

These and other features can be accomplished in embodiments of the present invention by providing toner and developer compositions. More specifically, in one embodiment of the present invention there are provided toner compositions comprised of pigment particles and resin polymer particles, and wherein the toner is subjected to halogenation resulting in the formation of a toner shell. The aforementioned toner resin particles are preferably comprised of ultra low melt resin polymers, which in embodiments of the present invention possess a glass transition temperature of from about 20° to about 75° C., and preferably from about 33° to about 60° C. as determined by DSC (differential scanning calorimetry), and wherein the toner melts at from about 220° to about 300° F. and preferably 250° F. The halogenated, especially chlorinated, encapsulating polymer surfaces can possess glass transition temperature values between about 55° and 110° C., and preferably from about 100° to about 110° C. in embodiments of the present invention. The high glass transition temperature surfaces, or shell impart, for example, robustness to the toners. The toner core comprised of resin and pigment has, for example, a glass transition temperature of from about 20° to about 110° C., preferably from about 25 to about 60, and more preferably about 40° C. in embodiments of the present invention, thus the toner is considered a low, or ultra low melting composition. The glass transition temperatures mentioned herein were in all instances, including the working examples, unless otherwise noted, determined by DSC (differential scanning calorimetry).

The toners of the present invention in embodiments are comprised of low melting resin particles and pigment particles, which have usually been prepared in an extrusion or melt mixing apparatus, followed by attrition and classification to provide toners with an average diameter of from about 7 to about 25 microns, and preferably about 10 microns. Subsequently, the toner obtained is subjected to halogenation, especially chlorination, by, for example, admixing the toner with an aqueous solution of the halogen. Halogens include chlorine, bromine, iodine, and fluorine, with chlorine being preferred. With fluorine, an aqueous solution is not utilized, rather there is selected fluorine with an inert atmosphere. Although it is not desired to be limited by theory, it is believed that the halogen, especially the chlorine, adds across the double bonds of the toner resin particles to form carbon-halogen bonds. The aforementioned can be considered an addition reaction, that is for example the halogen reacts with, and diffuses into the toner resin, whereby a shell thereof is formed. The shell can be of various effective thicknesses; generally, however, the shell is of a thickness of from about 1 micron or less, and more specifically from about 0.1 to about 1 micron, in embodiments. Typical amounts of halogen consumed include, for example, from about 0.1 to about 1 gram of halogen per 100 grams of toner polymer resin. In an embodiment, the toner composition is admixed with a solution of water and chlorine, which solution has a pH of from about 2.0 to about 3.0, and preferably about 2.5. Specifically, about 150 grams of toner can be added in 300 milliliters of an alcohol, such as ethanol, to about 7.5 liters of a chlorine solution at a pH of between about 2.5 and about 3.0, resulting in a pH thereof of from about 2.6 to about 3.2 after about 20 minutes. Generally, from about 100 grams to about 200 grams of toner are admixed with from about 5 to about 10 liters of halogen solution, especially chlorine solution, which solution is comprised of water and halogen, it being noted that a fluorine solution is usually not selected as indicated herein. A sufficient amount of toner and halogen solution are admixed to enable the formation of an effective shell. The toner of the present invention in embodiments possess a melting temperature of from about 220° to about 300°, and preferably about 250° F., as determined in a Xerox Corporation 1075 TM imaging apparatus fuser operating at a speed of about 11 inches per second, or a Xerox Corporation 5028 TM imaging apparatus fuser operating at a speed of about 3.3 inches per second. The toners of the present invention can have excellent nonblocking characteristics, that is they do not cake or agglomerate; caking and agglomeration are usually considered unacceptable at temperatures of from, for example, about 100° F. to about 125° F. The blocking temperatures can be determined by a number of methods; for example, the blocking temperatures of the toners can be determined by placing a sample of the toner, for example from about 5 to about 10 grams, in an aluminum pan of about 2 inches in diameter and about 0.5 inch in height, and heated at 110° F. for 24 hours, followed by repeating the heating at 115°, 120°, and 125° F. for 24 hours at each temperature. Should the toner become caked, agglomerated, or slightly agglomerated as determined by visual observation and by touch, it fails the aforementioned blocking test. Toners that pass the blocking test are free flowing thereby permitting images of high quality to be continuously obtained in imaging apparatus, especially xerographic imaging and printing devices operating at high speed of greater than about 75 copies per minute wherein the temperature thereof can attain a value of as high as about 115° F. Shell formation can be indicated, for example, by the aforementioned blocking test, the reactants selected, and by analytical methods.

More specifically, in one embodiment the ultra low melt resin polymers of the present invention are of the formula $(A—B)_n$ wherein n represents the number of A and B repeat segments and where A and B represent monomeric of oligomeric segments. The number of A and B repeat polymer segments n, in embodiments of the present invention, is from about 1 to about 100, and preferably from about 3 to about 35. Accordingly, the ultra low melt resin polymers of the present invention usually contain at least two A segments, and at least one B segment, and up to 100 A and 100 B segments. The number average molecular weight of the ultra low melt resin polymers of the present invention depends on the number of A and B segments, the toner properties desired, and the like; generally, however, the GPC number average molecular weight is from about 3,000 to about 100,000 and preferably from about 6,000 to about 50,000. In another embodiment of the present invention, the ultra low melt resin polymers are comprised of, for example, a number of polystyrene segments and, for example, a number of polydiene derived segments, such as polybutadiene. A polystyrene content of between about 70 to about 95 percent by weight is preferred in embodiments of the present invention. A polybutadiene content of between about 15 to about 100 percent by weight is preferred in an embodiment of the present invention. The total butadiene content of the resins is between 15 to about 40 percent by weight and the total polystyrene is, for example, between about 60 to about 85 percent by weight. The preferred enchainment of polybutadiene and other polymerized 1,3 dienes in an embodiment of the present invention is the 1,2-vinyl regioisomer of between about 80 to about 90 percent and the 1,4-cis and trans regioisomers of between about 10 to about 20 percent by weight of the total enchained butadiene. Thus, in one embodiment ultra low melt resin polymers containing polybutadiene segments having high 1,2-vinyl butadiene regioisomer enchainments are selected. In another embodiment, a suspension of poly(styrene, 18 to 22 weight percent of butadiene) copolymer is preferred in which nearly all of the butadiene is in the 1,4-regioisomer. The glass transition temperature of the aforementioned resin is 36° C. and GPC $M_w/M_n = 120{,}000/15{,}000$. In another embodiment, an emulsion poly(styrene-1,4-butadiene) copolymer available from Goodyear was encapsulated with halogen surface treatment.

The ultra low melt toners of the present invention in embodiments thereof satisfy the criteria of the known blocking test (anticaking property) above the core polymer glass transition temperatures. For example, several ultra low melt resin polymers of the present invention have core glass transition temperatures of from about 35° to about 50° C. and the resulting toner possesses acceptable blocking characteristics at 125° F. The blocking test can be accomplished as indicated herein by placing a toner powder sample, about 5 to about 10 grams prepared by halogen encapsulation of ultra low melt toner, into a convection oven according to the sequence of one day (24 hours) at 110° F., a second day at 115° F., a third day at 120° F., a fourth day at 125° F., and a fifth day at 130° F. When the toner samples have excellent powder flow properties and are free flowing, the blocking test has been satisfied, or passed. Caking, including slight caking, and aggregation of the toner is usually considered unacceptable and results in a blocking test failure.

DESCRIPTION OF EMBODIMENTS OF THE PRESENT INVENTION

Figure 1:
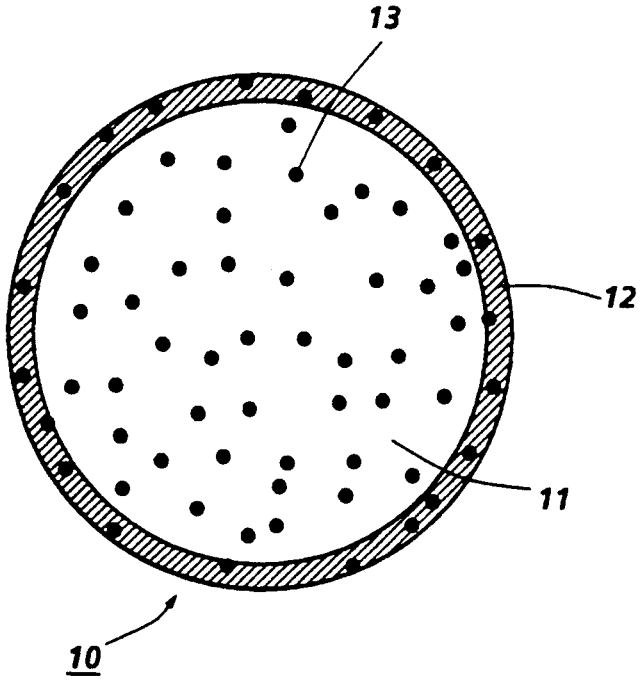
FIG. 1 represents in an embodiment a toner, example 10, of the present invention. The encapsulated toner particle 10 is comprised of low melt polymer resin 11, an encapsulating higher melting shell 12, and pigment or other internal additives 13, and optionally surface or external additives. The higher melting shell 12 can be comprised of halogenated polymer resin 11, colorant, or pigment, and additives, such as a charge control component in embodiments of the present invention.

Examples of ultra low melt resin polymers of the present invention include those as illustrated herein, wherein component A represents one oligomeric segment such as polystyrene, poly-alpha-methyl styrene, and the like, and wherein component B represents another oligomeric segment, such as polybutadiene, polyisoprene, partially, that is incompletely, hydrogenated polybutadiene, partially hydrogenated polyisoprene, partially halogenated polybutadiene, partially halogenated polyisoprene, and the like. Examples of polymers include ultra low melt polymers of the formula $(A—B)_n$ wherein n is a number of from 2 to about 100; polyolefins; semicrystalline polymers; liquid crystalline polymers and liquid glass polymers and random copolymers of styrene and butadiene obtained by anionic, free radical, suspension, dispersion, emulsion or bulk polymerization. Moreover, other unsaturated polyester resins may be suitable for effective halogenation, for example, branched or linear polyesters available, for example, from Resana.

Other low melting or ultra low melting resins suitable for use in the present invention and for halogenation are illustrated in U.S. Pat. No. 5,158,851 entitled "LIQUID GLASS RESINS", the disclosure of which is incorporated herein by reference in its entirety.

The ultra low melt resins can, for example, be represented by the following formulas wherein the substituents are as indicated herein, that is for example m, n and o represent the number of segments:

I. poly($styrene_m$—$butadiene_n$)
II. poly($styrene_m$—$isoprene_n$)
III. poly($styrene_m$—$butadiene_n$—$butene_o$)
IV. poly($styrene_m$—$isoprene_n$—$isopentene_o$)
V. poly($styrene_m$—$butadiene_n$)—$CO_2H$
VI. $HO_2C$—[poly($styrene_m$—$butadiene_n$)]—$CO_2H$
VII. poly($styrene_m$—$butadiene_n$—$dihalobutene_o$)
VIII. poly($styrene_m$—$isoprene_n$—$dihaloisopentene_o$).

In embodiments, preferred ultra low melt polymer structures are of Types I through VIII and particularly preferred are I and III. Ultra low melt polymers of Type I are preferred, for example, since their preparation is simple, that is a one pot synthesis requiring a single step, and their superior performance characteristics such as lowered minimum fix temperature and elevated hot offset temperature properties in embodiments of the present invention. Further, ultra low melt polymers of Type I are preferred because of their lower costs and ease of preparation in water.

Specific examples of ultra low melt polymers include poly(styrene-butadiene) with a number average molecular weight of from about 3,000 to about 100,000 with a molecular weight of about 20,000 to about 100,000 being preferred; polystyrene polyisoprene with a number average molecular weight of from about 3,000 to about 100,000; partially, for example, from about 5 to about 75 percent of hydrogenated polystyrene polybutadiene with a number average molecular weight of from about 3,000 to about 100,000; partially, for example, from about 5 to about 75 percent of hydrogenated polystyrene polyisoprene with a number average molecular weight of from about 3,000 to about 100,000; ionizable, that is containing ionizable end groups, for example —$CO_2H$, polystyrene polybutadiene with a number average molecular weight of from about 3,000 to about 100,000; ionizable polystyrene-polybutadiene with a number average molecular weight of from about 3,000 to about 100,000; partially halogenated, especially partially chlorinated polystyrenepolybutadiene with a number average molecular weight of from about 3,000 to about 100,000; and partially halogenated, especially chlorinated polystyrene-polyisoprene with a number average molecular weight of from about 3,000 to about 100,000.

In embodiments, the phase "ultra low melt" resins is intended to illustrate the physical and thermomechanical properties of the material, that is these resins exhibit glass transition temperatures (Tg) that are typically less than about 50° C., but may be from about 20° C. to about 75° C.

A suitable source of low melt resins can be derived from anionic polymerization of styrene and butadiene which allows for the preparation of random, block or multiblock copolymers with precise control of molecular weight, stereochemistry of the diene component, and monomer content and sequence. This high degree of architectural control is made possible since, for example, anionic polymerization conditions generate "living" polymers wherein the styrene and butadiene may be interchanged during the polymerization process by the operator. Hence, unique A-B type multiblock polymer compositions may be prepared as illustrated in U.S. Pat. No. 5,158,851, the disclosure of which is incorporated herein by reference in its entirety. Moreover, suspension, emulsion and bulk styrene-butadiene copolymers may be used. These suspension polymers are easy to prepare, of low cost, and do not require rigorously purified reagents and solvents unlike anionic polymers.

Generally, the ultra low melt resin polymers of the present invention in embodiments thereof can be prepared by well established procedures, for example suspension styrene-butadiene polymers of U.S. Pat. No. 4,560,635, the disclosure of which is totally incorporated herein by reference; the aforementioned anionic styrene-butadiene polymer processes, U.S. Pat. No. 5,158,851; and commercially available SPAR TM resins available from Resana Inc. of Brazil.

While not being desired to be limited by theory, it is believed that the reaction of diatomic halogens such as chlorine ($Cl_2$), bromine ($Br_2$), and fluorine ($F_2$) with toner particles prepared from low melt resin polymers results in the formation of a product on the surface of the toner particle that acts as a protective skin. The reaction of low melt resins with, for example, bromine ($Br_2$), iodine ($I_2$) or mixtures thereof can provide products with low glass transition temperatures, for example a styrene, 28.6 weight percent (85 weight percent 1,2-vinyl)butadiene copolymer with a glass transition $T_g$ of about 47° C. that was exhaustively treated with bromine and iodine provided brominated and iodine polymer products with Tg values of less than 55° C.; chlorine treatment yielded a polymer product with a Tg of 107° C.; and fluorine treatment can be expected to provide a polymer product with a Tg of greater than about 100° C. Other chemical agents which react with olefin containing polymers to form stable products having elevated glass transition temperatures that are comparable to the surface halogenated low melt toner particles may be used in the encapsulation step, for example, sulfur dioxide ($SO_2$), and the like, as described in "Polymer Synthesis", Wiley Interscience, the disclosure of which is incorporated by reference in its entirety. The halogenated or chemically treated protective skin is substantially uniform over the entire surface of the particle and constitutes essentially a continuous thin shell of a halogenated derivative product of the starting ultra low melt resin. The shell may in embodiments contain colorant, or pigment and additives, such as charge control components. The halogenated shell material has a substantially higher glass transition temperature, for example from about 50° to about 110° C. depending on shell thickness, compared with the starting material, low melt resin. The shell thickness may be controlled by the selection of the reactants, and the reaction conditions. Although not desired to be limited by theory, it is believed that the unique properties of the surface halogenated resin toner particles described herein derive from the mechanically rigid and higher melting protective shell which can be an integral part of the toner.

The temperature of the halogenation reaction depends on the reactivity of the reagents, for example a temperature of between about 0° C. and about 100° C., and preferred temperatures of between about 25° C. and about 75° C. can be selected. The relative concentration of toner particles, for example from about 0.1 to about 80.0 weight percent of toner per unit volume of the suspending medium, halogen concentration and the duration of exposure of the particles to the halogenating agent, controls the extent of the surface reaction.

The toner particle halogenation reactions, that is the reaction of preformed low melt toner particles with solution or gaseous halogens, may be accomplished batchwise or continuously in, for example, a fluidized bed reactor. The surface halogenated toner particle products are isolated in nearly quantitative yields based on the weight of low melt particles and the amount of dihalogen incorporated by chemical reaction into the polymer resin on the surface of the particles. The surface halogenated toner particle products can be identified and characterized using standard methods, many of which are common to modern polymer and toner-developer technology practice as described in the aforementioned published references and which become evident from a review of the working Examples.

In another embodiment, the aforementioned ultra low melt resin polymers may be partially catalytically hydrogenated to convert some, for example up to 50 percent, of the olefinic double bonds in the polymer chain backbone and pendant groups into the corresponding saturated hydrocarbon functionality prior to toner fabrication and surface halogenation. In many instances, partial hydrogenation of ultra low melt resins can provide further control of the variety of the rheological properties that may be obtained from the encapsulated low melt toner particles upon subsequent surface halogenation. Partial hydrogenation is accomplished with a solution of the ultra low melt polymer in contact with an effective amount, for example from about 10 to about 25 percent, of hydrogen gas under pressure in the presence of an appropriate catalyst, for example the known Wilkinson's catalyst, and diimide generated by a variety of known methods, and the like.

In another embodiment, the aforementioned ultra low melt toner particles are halogenated, partially or exhaustively, for example 100 percent, to convert olefinic double bonds by an electrophilic addition reaction in the surface polymer chain backbone and pendant groups into the corresponding halogenated hydrocarbon functionality. In many instances, surface halogenation of toner particles affords further control of the variety of rheological properties that may be obtained from ultra low melt polymer resins. Surface halogenation is accomplished with a gaseous mixture or liquid solution of an effective amount of from 0.01 to about 5 double bond molar equivalents of halogen gas or halogen liquid dissolved in water, or an organic solvent, for example chlorine gas, liquid bromine, or crystalline iodine dissolved in a solvent, such as an aliphatic alcohol, like ethanol which does not dissolve or substantially alter the size or shape of the toner particles.

When more reactive halogens such as fluorine ($F_2$) are used, an inert carrier gas, such as argon or nitrogen, may be selected as a diluent, for example, from about 0.1 to about 98 percent by volume of the inert gas relative to the reactive halogen gas, to moderate the extent of reaction, and the temperature and control corrosivity of the encapsulation process.

A number of equally useful halogenating agents are known that afford equivalent reaction products with olefinic double bonds as the aforementioned diatomic halogens, for example as disclosed by House in "Modern Synthetic Reactions", W. A. Benjamin, Inc.,2nd Ed., Chapter 8, page 422, and references cited therein, the disclosure of which is incorporated in its entirety by reference.

The encapsulated low melt toner particles of the present invention usually consume less energy in attaching the toner to a substrate, that is for example their heat of fusion is usually less than the semicrystalline polymers, a high heat of fusion being about 250 Joules/gram, and the heat of fusion being the amount of heat needed to effectively and permanently fuse the toner composition to a supporting substrate such as paper. The encapsulated low melt toner particles of the present invention also consume less energy and are believed to be more readily processable than semicrystalline polymers because the processing characteristics of the low melt resin polymers are sufficiently brittle so as to facilitate micronization, jetting and classification of the bulk toner composition to particles of appropriate functional toner dimensions. In addition, the aforementioned low melt resin polymers generally possess in embodiments a number average molecular weight of from about 3,000 to about 100,000, and have a dispersity $M_w/M_n$ ratio of about 1 to about 8 and preferably about 2 or less.

The aforementioned toner resin polymers are generally present in the toner composition in various effective amounts depending, for example, on the amount of the other components, and the like. Generally, from about 70 to about 95 percent by weight of the low melt resin is present, and preferably from about 80 to about 90 percent by weight.

Numerous well known suitable pigments or dyes can be selected as the colorant for the toner particles including, for example, carbon blacks available from Cabot Corporation such as REGAL 330®, BLACK PEARLS L TM, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent, and preferably from about 2 to about 10 weight percent based on the total weight of the toner composition, however, lesser or greater amounts of pigment particles may be selected in some embodiment of the present invention.

Various magnetites, which are comprised of a mixture of iron oxides ($FeO.Fe_2O_3$) in most situations, including those commercially available such as MAPICO BLACK TM, can be selected for incorporation into the toner compositions illustrated herein. The aforementioned pigment particles are present in various effective amounts; generally, however, they are present in the toner composition in an amount of from about 10 percent by weight to about 30 percent by weight, and preferably in an amount of from about 16 percent by weight to about 19 percent by weight. Other magnetites not specifically disclosed herein may be selected.

A number of different charge enhancing additives may be selected for incorporation into the bulk toner prior to halogenation, or onto the surface of the toner compositions subsequent to halogenation so as to avoid undesirable side reactions between the halogen and the surface additives of the present invention to enable these compositions to acquire a positive or negative charge thereon of from, for example, about 10 to about 35 microcoulombs per gram as determined by the known Faraday Cage method for example. Examples of charge enhancing additives include alkyl pyridinium halides, including cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other similar known charge enhancing additives, such as distearyl dimethyl ammonium bisulfate, reference U.S. Pat. Nos. 4,937,157 and 4,904,762, and the like, as well as mixtures thereof in some embodiments. These additives are usually present in an amount of from about 0.1 percent by weight to about 15 percent by weight, and preferably these additives are present in an amount of from about 0.2 percent by weight to about 5 percent by weight. A number of different known charge enhancing additives may be selected for incorporation into the bulk toner, or onto the surface of the toner compositions of the present invention to enable these compositions to acquire a negative charge thereon of from, for example, about −10 to about −35 microcoulombs per gram. Examples of known negative charge enhancing additives include alkali metal aryl borate salts, for example potassium tetraphenyl borate, reference U.S. Pat. No. 4,767,688 and U.S. Pat. No. 4,898,802, the disclosures of which are totally incorporated herein by reference; the aluminum salicylate compound BONTRON TM E-88 and zinc complexes, such as BONTRON TM E-44 available from Orient Chemical Company; the metal azo complex TRH available from Hodogaya Chemical Company; and the like.

Additionally, because chloropolymers are situated intermediate in the triboelectric series of resins, both negative and positive toners can be prepared without added charge control agents provided the carrier is selected appropriately.

Moreover, the toner composition can contain as internal or external components other additives, such as colloidal silicas inclusive of AEROSIL TM, metal salts, such as titanium oxides, tin oxides, tin chlorides, and the like; metal salts of fatty acids such as zinc stearate, reference U.S. Pat. No. 3,590,000 and 3,900,588, the disclosures of which are totally incorporated herein by reference; and waxy components, particularly those with a molecular weight of from about 1,000 to about 15,000, and preferably from about 1,000 to about 6,000, such as polyethylene and polypropylene, which additives are generally present in an amount of from about 0.1 to about 5 percent by weight.

The low melt toner particle compositions prior to the shell forming halogenation step of the present invention can be prepared by a number of known methods including melt blending the toner resin particles, and pigment particles or colorants, followed by mechanical attrition. Other methods include those well known in the art such as spray drying, melt dispersion, dispersion polymerization, extrusion, and suspension polymerization; known micronization and classification of the toner can be accomplished to enable toner particles with an average diameter of from about 10 to about 25 microns. The toner particle size or size distribution is not believed to be significantly altered by the surface halogenation shell forming step. The halogen surface treated toner particles appear less likely to form toner agglomerates during normal processing, handling and in dispensing in copier and printing machines. Thus, the processability, handling and dispensing of the halogen encapsulated toner particles of the present invention are improved in embodiments compared to the corresponding nonhalogen treated toner particles from which the halogenated resin encapsulated toner was prepared.

Characteristics associated with the toner compositions of the present invention in embodiments thereof include a fusing temperature of less than about 225° to about 250° F., and a fusing temperature latitude of from about 250° to about 350° F. Moreover, it is observed that the aforementioned toners possess stable positive or negative triboelectric charging values of from about 10 to about 40 microcoulombs per gram and the triboelectric charging values are stable for an extended number of imaging cycles exceeding, for example, in some embodiments one million developed copies in a xerographic imaging apparatus, such as for example the Xerox Corporation 1075 TM. Although it is not desired to be limited by theory, it is believed that two important factors for the slow, or substantially no degradation in the triboelectric charging values reside in the unique physical properties of the halogen treated toner particles selected, and moreover the stability of the carrier particles utilized. Also of importance in embodiments of the present invention is the consumption of less energy with the toner compositions since they can be fused at a lower temperature, that is about 230° F. (fuser roll set temperature) compared with other conventional toners including those containing certain styrene butadiene resins which fuse at from about 300° to about 330° F. In addition, the halogen treated toner particles possess in some embodiments the other important characteristics mentioned herein inclusive of a toner core glass transition temperature of from about 24° to about 74° and preferably from about 24° to about 60° C.

As carrier particles for enabling the formulation of developer compositions when admixed in a Lodige blender, for example, with the toner, there are selected various known components including those wherein the carrier core is comprised of steel, nickel, magnetites, ferrites, copper zinc ferrites, iron, polymers, mixtures thereof, and the like which cores may contain known polymeric coatings such as polymethylmethacrylates, methyl terpolymers, KYNAR ®, TEFLON ®, and the like. Also useful are the carrier particles as illustrated in U.S. Pat. Nos. 4,937,166 and 4,935,326, the disclosures of which are totally incorporated herein by reference. These carrier particles can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles comprised of a core with a coating thereover comprised of a mixture of a first dry polymer component and a second dry polymer component. The aforementioned carrier compositions can be comprised of known core materials including iron with a dry polymer coating mixture thereover. Subsequently, developer compositions of the present invention can be generated by admixing the aforementioned carrier particles with the toner compositions comprised of the liquid glass resin particles, pigment particles, and other additives.

Thus, a number of suitable solid core carrier materials can be selected. Characteristic carrier properties of importance include those that will enable the toner particles to acquire a positive or negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Preferred carrier cores include ferrites and sponge iron, or steel grit with an average particle size diameter of from between about 30 microns to about 200 microns.

Illustrative examples of polymer coatings selected for the carrier particles include those that are not in close proximity in the triboelectric series. Specific examples of polymer mixtures selected are polyvinylidenefluoride with polyethylene; polymethylmethacrylate and copolyethylenevinylacetate; copolyvinylidene fluoride tetrafluoroethylene and polyethylene; polymethylmethacrylate and copolyethylene vinylacetate; and polymethylmethacrylate and polyvinylidene fluoride. Other coatings, such as polyvinylidene fluorides, fluorocarbon polymers including those available as FP-461, terpolymers of styrene, methacrylate, and triethoxy silane, polymethacrylates, reference U.S. Pat. Nos. 3,467,634 and 3,526,533, the disclosures of which are totally incorporated herein by reference, and not specifically mentioned herein can be selected providing the objectives of the present invention are achieved.

With further reference to the polymer coating mixture, by close proximity as used herein it is meant that the choice of the polymers selected are dictated by their position in the triboelectric series, therefore, for example, one may select a first polymer with a significantly lower triboelectric charging value than the second polymer. Other known carrier coatings may be selected such as fluoropolymers like KYNAR 301F TM, styrene terpolymers, trifluorochloroethylene/vinylacetate copolymers, polymethacrylates, and the like, at carrier coating weights of, for example, from about 0.1 to about 5 weight percent.

The carrier coating for the polymer mixture can be present in an effective amount of from about 0.1 to about 3 weight percent for example. The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer such as a polyvinylidene fluoride commercially available as KYNAR 301F TM, and 50 percent by weight of a second polymer such as polymethylacrylate or polymethylmethacrylate. In contrast, when a lower triboelectric charging value is required, less than, for example, about 10 microcoulombs per gram, there is selected from about 30 percent by weight of the first polymer, and about 70 percent by weight of the second polymer.

Generally, from about 1 part to about 5 parts by weight of halo-encapsulated toner particles are mixed with 100 parts by weight of the carrier particles illustrated herein enabling the formation of developer compositions.

Also encompassed within the scope of the present invention are colored toner compositions comprised of toner resin particles, and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720; Cl Dispersed Red 15, a diazo dye identified in the Color Index as Cl 26050; Cl Solvent Red 19; and the like. Examples of cyan materials that may be used as pigments include copper tetra-4-(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; and the like; while illustrative examples of yellow pigments that may be selected are diarylide yellow 3,3-dichlorobenzidene acetoacetanilides, a monoazo pigment identified in the Color Index as Cl 12700; Cl Solvent Yellow 16, a nitrophenyl amine sulfonamide identified in the Color Index as Foron Yellow SE/GLN; Cl Dispersed Yellow 33, a 2,5-dimethoxy-4-sulfonanilide phenylazo-4'-chloro-2,5-dimethoxy acetoacetanilide; Permanent Yellow FGL; and the like. These pigments are generally present in the toner composition prior to surface halogenation in an amount of from about 1 weight percent to about 15 weight percent based on the weight of the unhalogenated toner resin particles.

The toner and developer compositions of the present invention may be selected for use in electrophotographic imaging processes containing therein conventional photoreceptors, including inorganic and organic photoreceptor imaging members. Examples of imaging members are selenium, selenium alloys, such as selenium tellurium, selenium arsenic, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl amines disclosed in the '990 patent. Also, there can be selected as photogenerating pigments, squaraine compounds, azo pigments, perylenes, thiapyrillium materials, and the like. These layered members are conventionally charged negatively, thus usually a positively charged toner is selected for development. Moreover, the developer compositions of the present invention are particularly useful in electrophotographic imaging processes and apparatuses wherein there is selected a moving transporting means and a moving charging means; and wherein there is selected a flexible, including a deflected, layered imaging member, reference U.S. Pat. Nos. 4,394,429 and 4,368,970, the disclosures of which are totally incorporated herein by reference. Images obtained with the developer compositions of the present invention in embodiment theory possess acceptable solids, excellent halftones and desirable line resolution with acceptable or substantially no background deposits. The toner compositions of the present invention may also be used for single component electrophotographic imaging processes and direct electrostatic printing processes.

Embodiments of the present invention include a toner composition comprised of halogen surface treated low melt toner particles with a core glass transition temperature of between from about 20° C. to about 75° C., and pigment particles; a toner composition wherein the low melt toner particles are comprised of low melt resin polymer of the formula $(A—B)_n$ wherein A represents a polymer segment of a first monomer, B represents a polymer segment of a second monomer, and n is at least 1 and represents the number of A and B segments; a method for developing images which comprises the formation of an electrostatic latent image on a photoconductive member, developing the resulting image with the toner composition, subsequently transferring the developed image to a suitable substrate, and thereafter permanently affixing the image thereto; a method for developing images which comprises the formation of an electrostatic latent image on a photoconductive member, developing the resulting image with the toner composition, subsequently transferring the developed image to a suitable substrate, and thereafter permanently affixing the image thereto; a process for the preparation of surface halogenated toner particles comprising suspending low melt resin toner particles in a liquid containing dissolved diatomic halogen with the halogen being from about 0.01 to about 5 double bond molar equivalents of the olefins of the particle surface polymer; a surface halogenated toner particle comprised of low melt toner resin polymers wherein the aforementioned A segment is polystyrene, and the aforementioned B segment is polybutadiene; and a toner composition comprised of pigment particles and surface halogenated toner particles with a copolymer resin core with a glass transition temperature of between from about 20° C. to about 75° C.

The following Examples are being supplied to further define the present invention, it being noted that these examples are intended to illustrate and not limit the scope of the present invention. Parts and percentages are by weight unless otherwise indicated.

Generally, for the preparation of encapsulated toner compositions there was initially prepared the ultra low melt resin polymer. Thereafter, there are admixed with the ultra low melt resin polymer pigment particles and other additives by, for example, melt extrusion, and the resulting toner particles are jetted and classified to enable toner particles with an average volume diameter of from about 5 to about 25 microns, and preferably with an average volume diameter of from about 7 to about 15 microns. Subsequently, the toner particles are halogenated to provide an encapsulated low Tg core with a higher Tg halopolymer shell.

The invention will now be described in detail with reference to specific preferred embodiments thereof, it being understood that these examples are intended to be illustrative only. The invention is not intended to be limited to the materials, conditions, or process parameters recited herein. Also, all parts and percentages are by weight unless otherwise indicated. Toner compositions are described by weight percent of additives and the toner resin comprises the balance totaling 100 percent. Comparative data and Examples are also presented.

EXAMPLE I

Preparation of Low Melt Poly(styrene-butadiene) Toner Resin by Suspension Polymerization Tricalcium phosphate (2.5 grams) was suspended in a solution of ALKANOL TM, a sodium sulfonate salt of naphthalate available from E. I. DuPont (48 milligrams) in deionized water (40 milliliters). The mixture was added to a modified Parr pressure reactor containing 60 milliliters of deionized water. The reactor was sealed and the contents were stirred at approximately 500 rpm while being heated to 95° C. over a period of 40 minutes. The reactor was flushed with nitrogen gas. After 40 minutes, a solution of styrene (46.8 grams), 1,3-butadiene (13.2 grams), benzoyl peroxide (3.0 grams) and TAEC (0,0-t-amyl-0-(2-ethyl hexyl)monoperoxy carbonate available from Pennwalt or Lubrizol) (0.20 milliliter) was added to the reactor via a sparge tube, under positive pressure of nitrogen gas, over a period of 4 minutes. The final reactor pressure was typically from between 90 and 100 psi. The reaction proceeded at 95° C. for 192 minutes. Fifteen minutes before the end of the 95° C. ramp, the reactor was vented 5 times over a period of 10 minutes to liberate unreacted 1,3-butadiene. The reaction mixture was heated to 125° C. over 40 minutes, maintained at 125° C. for 60 minutes, then cooled. The product was stirred with nitric acid (6 milliliters) for 10 minutes, filtered, washed twice with 300 milliliters of deionized water and dried under vacuum 16 hours at 40° C. The yield was typically greater than 97 percent. The copolymer had a glass transition of 38° C., an $M_n$ of 11,000 and an $M_w$ of 108,000.

The Example I reaction was scaled up to a 10 gallon reactor and the product was a poly(styrene, 22 weight percent butadiene) copolymer with a glass transition of 36.9° C., an $M_n$ of 15,000 and an $M_w$ of 120,000.

EXAMPLE II

Preparation of Low Melt Toner Particles

Low melt toner particles were prepared by extruding in a ZSK extruder the low melt poly(styrene-butadiene) resin (94 percent and 95 percent, respectively) of Example I with 6 weight percent of Regal 330® carbon black both with and without 2 percent of cetyl pyridinium chloride (CPC). The extrudate was micronized to provide toner particles with an average diameter of 10 microns. The minimum fix temperature was 240° F. (without CPC) and 250° C. (with CPC), determined with a Xerox Corporation 5028 TM silicone fuser roll operating at 3.1 inches per second. Hot offset temperature was 295° F. (without CPC) and 290° F. (with CPC). Roll temperature was determined using an Omega pyrometer and was checked with wax paper indicators. Both toner materials failed blocking tests by fusing together near the glass transition temperature of the resin between 36° and 38° C. The triboelectric values against Xerox Corporation 1075 TM carrier comprised of steel coated with polyvinylidene fluoride, 0.75 percent, after 0.5 hour on a roll mill were 22.2 microcoulombs per gram at 3 percent toner concentration (without CPC) and 30.1 microcoulombs per gram at 3 percent toner concentration (with CPC) as measured with a standard known Faraday Cage apparatus.

The minimum fix temperature or the lowest fuser set temperature at which acceptable toner adhesion to paper took place was determined by a crease test, tape test, erasure (Pink Pearl) resistance and gloss 10 at 75 degrees. The crease test was accomplished as follow: a solid area image at 0.9 to 1.1 grams of toner per gram of paper (g/g) was folded 180 degrees with the image side inward. When unfolded, the crease area was observed as 60 visually and compared to Xerox Corporation 1075® imaging apparatus fix standards.

The tape test was accomplished by placing SCOTCH® brand Magic 810 (¾ inch) tape on the solid area of the fused toner image and the tape was then removed. The amount of toner retained by the tape (without paper fibers) was minimal as determined by visual observation. Hot offset temperature was determined when fused toner images offset, or transfer from paper onto the fuser roll and then reprint onto the same paper or onto other subsequent sheets of paper. Two known indications that offset results include printing on the fuser roll and ghost image areas on the final copy paper after transfer.

EXAMPLE III

Chlorination of Low Melt Toner Particles

The block low melt toner of Example II (5 grams) was suspended in 50 milliliters of ethanol and added to 250 milliliters of chlorine water in a Waring blender. The chlorine water was prepared by adding 200 milliliters of chlorine gas (0.6 to 0.7 gram) to 800 milliliters of water. After 15 minutes, the toner was isolated by filtration, washed with water and vacuum dried. The toner glass transition temperature had increased from 40.7° to 45.0° F. as a result of chlorine treatment. The minimum fix temperature for this toner was 240° F. and the hot offset temperature was 295° F. The toner product material passed a 125° F. blocking test. The blocking test was accomplished as indicated herein wherein a sample of the aforementioned chlorinated toner powder, about 5 grams, is placed in an aluminum pan, 2 inches in diameter and 0.5 inch in depth, and was heated (the dish and the toner) in a convection oven for 24 hours at 110° F., 24 hours at 115° F., 24 hours at 120° F., and 24 hours at 125° F. The toner remained free flowing and was free of aggregates and chunks as determined, for example, by visual observation subsequent to the aforementioned heatings. Therefore, the toner product of this Example passed the blocking test at 125° F.

Shell formation was determined in all instances by the reactants selected, passing of the blocking test and analytical methods. Specifically, shell formation was determined as follows: toner particles were inserted in an epoxy resin matrix and the particles were cross-sectioned with a microtone knife. The cross-sectional area of the entire toner particle and a portion of the particle surface depending on magnification, which was typically 100 to 1,000×, was then examined by scanning electron microscopy. When electrons struck areas of the high parts per thousand and greater chlorine concentration (as on the toner particle surface) X-rays generated by the impinging high energy electron beams were detected with a photomultiplier apparatus and mapped on a screen. Areas rich in chlorine generate chlorine specific X-rays whereas those without chlorine do not. Hence, the toner particles surface was mapped and the core was essentially chlorine free (the toner particles had continuous shells). Chlorine was specific to the surface of the toner particles and the shells were estimated to be 0.1 micron in thickness (shell thickness). The technique is called X-ray mapping generated in the SEM mode. The toner particles evidenced formation of a chlorine shell as determined by the above method.

EXAMPLE IV

Preparation of Anionic Low Melt Styrene-Butadiene Resin and Toner

All transfers were conducted under dry high purity argon. Cyclohexane was distilled over sodium hydride argon. Liquid butadiene measured by weight and volume was stored over sodium hydride in a septum capped beverage bottle at −15° C. Transfers were made with cannulas inserted directly into a weighed graduated cylinder containing cold cyclohexane under argon. Styrene was distilled under argon over sodium hydride. Rubber septa were used as stoppers. Tetrahydrofuran was distilled from blue sodium-benzophenone ketyl under argon. Lithium and naphthalene were used as received from Aldrich Chemical Company. Cooling of the reaction was carried out by means of a dry ice-isopropanol bath.

Lithium shot (4.25 grams) and natphthalene (37.5 grams) were added to a 500 milliliter Erlenmeyer flask equipped with a magnetic stir bar. The flask was then stoppered with a rubber septum and purged with argon. Tetrahydrofuran (250 milliliters) was added via cannula under argon. After stirring 16 hours under argon, the molarity of the lithium/naphthalene initiator solution was determined by carrying out a preliminary small scale polymerization followed by product molecular weight analysis. The initiator solution was 1.42 molar. A 12 liter flask equipped with a mechanical stirrer and two rubber septa was purged with argon. Freshly distilled tetrahydrofuran (1,500 milliliters) was added. Approximately 56 milliliters of 1.42 molar lithium/-naphthalene initiator solution was required to titrate impurities from the reaction vessel surface. Subsequently, 1.42 molar lithium/naphthalene initiator solution (93 milliliters) was added from a graduated cylinder via a cannula under argon. The reactor was cooled to −35° C. and the following solution of monomers was added in 5 equal portions: styrene (1,000 milliliters, 904.45 grams, 897.9 grams transferred), butadiene (752 milliliters, 507.3 grams, 502.86 grams transferred, of which 439.3 grams were incorporated into the product copolymer), cyclohexane (3,500 milliliters, 2,719 grams) and tetrahydrofuran (1,500 milliliters, 1,315.2 grams). Each of the five portions consisting of styrene (200 milliliters, 179.6 grams), butadiene (100.6 grams), cyclohexane (700 milliliters, 543.8 grams), and tetrahydrofuran (300 milliliters, 263 grams) was added over 17 minutes (±5 minutes) at 1 hour intervals such that complete addition of monomers had taken place in about 4 hours. The reaction mixture was then stirred 16 hours at 25° C. Isopropyl alcohol (20 milliliters) was added to terminate the living anions and the reaction solution was added to 10 gallons of isopropanol to precipitate the crude product polymer. The polymer collected by filtration was dissolved in methylene chloride at 20 weight percent solids and was then added to isopropanol (10 gallons) to reprecipitate the polymer. The polymer was collected by filtration and washed with methanol (5 gallons). The polymer in methylene chloride at 20 weight percent solids was added to 10 gallons of methanol to precipitate a white polymer which was collected by filtration and then vacuum dried at 25° C. The weight and number average molecular weights were 50,300 and 40,600, respectively, as determined by size exclusion chromatography. The $^1H$ NMR spectrum was consistent with a styrene-butadiene block copolymer with 32.85 weight percent (48.52 mol percent) of butadiene of which 91.3 percent were 1,2-vinyl groups. The glass transition temperature was 40.5° C. and the fictive temperature was 38.9° C., as determined by differential scanning colorimetry. The polymer yield was nearly quantitative, that is about 99 percent.

A toner was prepared by extrusion with the above polymer, 92 percent, 6 percent of Regal 330® carbon black and 2 percent of CPC (cetyl pyridinium chloride charge additive) followed by micronization to 10 microns. The minimum fix temperature of the toner was 210° F. as determined by no cracking of the fused toner images as a result of a 180° paper crease test (paper folded 180 degrees, visually observed the breadth of cracking at crease) and the minimum fix temperature of the toner was 230° F. when no appreciable, for example a peppered, toned image was removed with SCOTCH ® Tape Magic 810, and the hot offset temperature was 320° F. where the toned image sticks to silicone roll fuser as indicated herein. When fused, toner images were observed to offset from paper onto a silicone fuser roll, and then was imprinted onto the same paper or subsequent papers.

The above toner (150 grams) was suspended in ethanol (250 milliliters) and added to 7,000 milliliters of water that had been adjusted to pH 2.5 with chlorine gas. The toner after 15 minutes reaction with mechanical stirring was filtered, washed and dried. The formation of a chloropolymer chlorine mapping with shell was determined by transmission electron microscopy as illustrated herein, reference Example III. The minimum fix temperature was 245° F. and the hot offset temperature was greater than 400° F. The glass transition temperature of the toner had increased from 40.5° C. to 45.5° C. as a result of the chlorine treatment. The triboelectric values against Xerox Corporation 1075 TM carrier (steel coated with KYNAR ®) for the untreated (nonchlorinated) toner was 33.7 microcoulombs per gram (3.15 percent toner concentration) and was 19.9 mc/g, microcoulombs per gram, (3.3 percent toner concentration) after toner surface chlorination.

The minimum fix temperature is the lowest fuser set temperature at which acceptable toner adhesion to paper was accomplished as determined by the crease test, tape test erasure resistance, gloss 10 at 75° (angle), and taber abraser. The crease test was accomplished by repeating the process of Example III. The tape test is carried out by adhering SCOTCH ® brand Magic 810 (¾ inch tape) on the solid area and the tape is then removed. The amount of toner retained by the tape (without paper fibers) is quantified according to standards. A peppered toner image on the tape is the minimum fix temperature. Results similar to Examples II and III were obtained for both the crease and tape tests for the encapsulated chlorinated toner.

EXAMPLE V

Preparation of Low Melt Styrene-Butadiene Anionic Copolymer and Toner

A 12 liter, 3-neck flask equipped with two rubber septa and a mechanical stirrer was washed with 1.3 molar sec-butyllithium (50 milliliters) in cyclohexane (200 milliliters) and rinsed with cyclohexane (200 milliliters). Cyclohexane (1,500 milliliters), 1.3 molar sec-butyllithium (264 milliliters) and diisopropenyl benzene (27.21 grams) was added and heated 4 hours at 50° C., and the resultant red slurry was stirred 16 hours at 25° C. under argon. The reaction vessel was then cooled between 0° and −20° C. while tetrahydrofuran (2,325 milliliters) and cyclohexane (1,500 milliliters) were added. Next, cyclohexane (1,350 milliliters), styrene (1,350 milliliters) and butadiene (690 milliliters) were added in 5 equal portions at 1 hour intervals. Each of the 5 portions consisted of cyclohexane (270 milliliters), styrene (270 milliliters) and butadiene (138 milliliters) and was added over 5 minutes to the reaction mixture at between 0° and −20° C. After complete addition of monomers, the reaction was maintained for 2 hours at between 0° and −20° C. and was then allowed to stir at 25° C. for 16 hours. Isopropanol (20 milliliters) was added and the reaction solution became colorless. The polymer was isolated by precipitation into 10 gallons of 2-propanol, and then reprecipitated into 10 gallons of isopropanol from a 20 weight percent solution in methylene chloride. A final reprecipitation from 20 weight percent solids in methylene chloride into methanol (10 gallons) yielded a white powder that was isolated by filtration, and then vacuum dried. The product was a styrene, 28.58 weight percent butadiene copolymer with 86.1 percent double bonds as 1,2-vinyl groups. The GPC $M_w/M_n$ was 32,300/20,470, and the glass transition temperature was 45.5° C. The yield of white powder was 91 percent.

A xerographic toner was prepared with the above generated white powder polymer (92 percent by weight) by melt extrusion with 2 percent of TP-302 (Nachem) charge control additive and 6 percent of RegaL 330 ® carbon black followed by micronization to yield toner particles between 8 and 11 microns in average diameter. The triboelectric values as determined by the known Faraday Cage method were 39.6 microcoulombs per gram at 2.77 percent of toner concentration against 70 percent of polyvinylidine-fluoride and 30 percent polymethyl methacrylate coated (1.25 weight percent) steel carrier after 30 minutes roll mill. The minimum fix temperature was 220° F. and the hot offset temperature was between 290° and 300° F. using a Xerox Corporation 5028 TM silicone fuser roll operated at 3.1 inches per second. This toner failed the blocking test by melting and agglomerating at 110° C. After surface chlorination by repeating the chlorination process of Example IV, the toner passed the blocking test illustrated herein at 125° F. The aforementioned chlorine treated toner had a triboelectric charge of 21 microcoulombs per gram at 2.90 percent toner concentration against the Xerox Corporation 1075 TM carrier after 30 minutes of roll milling.

EXAMPLE VI

Preparation of Cyan Toners

The copolymer of Example V was combined with 2 percent of PV Fast Blue and the mixture was masticated in a Brabender melt mixer (plastograph) for 12 minutes at 100° C. The resultant plastic was jetted into toner between 8 and 10 microns and rolled against Xerox Corporation 1075 TM carrier. Images were developed on Hammermill laser print paper and on MYLAR ® transparency stock (treated with ethanol and air dried) using a solid area imaging device. The solid area imaging device consisted of a capacitor made with an aluminum plate (negative electrode) and NESA-glass positive electrode. Toner and carrier were cascaded onto paper situated between the two charged plates. This toner had a triboelectric charge of −100 microcoulombs per gram. After surface chlorination by repeating the chlorination process of Example IV the resulting toner with shell was evaluated against the Xerox Corporation 1075 TM resulting in a toner tribo of −40 microcoulombs per gram. The chlorine treated toner passed the blocking test at 125° F., and this toner had a minimum fix temperature of 240° F. and a hot offset temperature of 295° F. using a Xerox Corporation 5028 TM silicone fuser roll operating at 3.1 inches per second.

EXAMPLE VII

Preparation of Magenta Toner

The individual copolymers (47 grams) of Examples I and II were combined with 1 percent of potassium tetraphenyl borate and 5 percent of Hostaperm Pink E from Hoescht. The individual mixtures (50 grams of each) were masticated in a Brabender melt mixer for 30 minutes at 130° C. and 30 minutes at 70° C. The resultant resins were jetted into 8 to 10 micron particles and rolled against Xerox Corporation 1075 TM carrier for 30 minutes on a roll mill. Solid area prints were generated with the solid area imaging device of Example VI on laser print paper and transparency stock. The aforementioned two individual toners (5 grams each in 50 milliliters of ethanol) were respectively added to 250 milliliters of chlorine water solutions with stirring. The chlorine water was prepared by adding 200 milliliters of chlorine to 800 milliliters of water. After 15 minutes, the toners were isolated by filtration, washed and dried. The formation of the 0.1 micron chloropolymer shell was evidenced by transmission electron microscopy. Triboelectric properties were determined against Xerox Corporation 1075 TM carrier particles. The tribo values in the Table that follows indicate that the chloropolymer shell passivates the influence of the pigment with respect to tribo charge, and that the chloropolymer shell is situated in a location on the known triboelectric series that is usable with a number of known carriers such as steel coated with a mixture of KYNAR TM and polymethylmethacrylate (60/40).

TABLE I

Tribo Values of Magenta Toners Before and After Chlorination

| Toner Composition | Tribo Microcoulombs per gram (% TC)[a] |
|---|---|
| 22 Weight Percent of Styrene Butadiene Suspension Polymer[b] - Unchlorinated | −30.1 (2.94) |
| Chlorinated Toner With 22 Percent of Styrene Butadiene[b] | −11.2 (3.35) |
| Anionic Styrene Butadiene Copolymer[b] - Unchlorinated | −50.1 (3.22) |
| Chlorinated Toner With Styrene Butadiene Copolymer[b] | −19.5 (3.67) |

[a]toner concentration against magnetic carrier
[b]1 percent of potassium tetraphenyl borate (KTPB) and 5 percent of Hostaperm Pink The MFT of the chlorinated toners of Example VII with the resins of Examples I and II as indicated increased by 10° F. over that of the untreated (no chlorination and no shell formation) toners. The chlorine treated toners passed the blocking tests at 125° F.; while the unchlorinated toners failed the blocking test at 104° F.

EXAMPLE VIII

Preparation of Black Toner

The copolymer of Example V was melt mixed using a CSl miniextruder with 6 percent of Regal 330® carbon black with and without 2 percent of CPC (cetyl pyridinium chloride). The resin was then jetted into 8 to 10 micron toner particles using a Gem T trost jet mill. The triboelectric values against Xerox Corporation 1075 TM carrier were 22.54 microcoulombs per gram (2.85 percent toner concentration) without CPC and 49.43 microcoulombs per gram (3.06 percent toner concentration) with CPC. The minimum fix temperatures were MFT=220; HOT=295° F. (without CPC) and MFT=230; HOT=300° F. (with CPC), respectively.

EXAMPLE IX

Preparation of Unpigmented Toner Particles

The copolymer of Example V was melt extruded using a CSI miniextruder and then micronized to between 8 and 10 micron toner particles using a Gem T Trost jet mill. A colorless toner was obtained. After treatment with chlorine by repeating the process of Example III, the toner resulting was analyzed with ESCA (X-ray photoelectron spectroscopy). The spectrum resulting was consistent with carbon-chlorine sigma bonds and some carbon-oxygen sigma bonds.

Although not desired to be limited by theory, it is believed that when chlorine gas is added to water, three reactions (a–c) are important with regard to available chlorine for reaction with carbon-carbon double bonds.

| | | |
|---|---|---|
| $Cl_2 + H_2O \rightleftharpoons Cl^- + H_3O^+ + HOCl$ | $K = 4.7 \times 10^{-4}$ | (a) |
| $HClO \rightleftharpoons H^+ + ClO^-$ | $K = 3.2 \times 10^{-8}$ | (b) |
| $2HOCl + 2H_2O \rightarrow 2H_3O^+ + 2Cl^- + O_2$ | | (c) |

Moreover, the electrode potential for the reaction $$2HOCl + 2H_3O^+ + 2e^- \rightarrow Cl_2 + 4H_2O$$

is $E° = +1.63$ V (which is greater than for $MnO_4^-$ at $E° = 1.54$ v),

The initial pH of the chlorine water solution can be used to calculate the concentration and amount of chlorine assuming reaction (c) is slow.

HOCl will add to alkenes as readily as $Cl_2$, however, the competing side reaction to form carbon-oxygen bonds is limited because the equilibrium constant for equation (a) $K = 4.7 \times 10^{-4}$ is small.

Toner particle surface halogenation chemistry can be represented by the following equations:

$$Cl_2 + —CH=CH— \longrightarrow —CHCl\text{-}CHCl—$$

$$ClOH + —CH=CH— \longrightarrow —CHCl\text{-}CH(OH)—$$

(a slightly detectable side reaction as evidenced by ESCA and Fournier Transform Infrared Spectroscopy (FTIR)).

If chlorine ($Cl_2$) is present in sufficient quantities, it will titrate every available double bond in much the same way that bromine does. Bromine has long been recognized as a reagent to quantify alkenes. There is no evidence by GPC of polymer or particle crosslinking as a result of the surface halogenation conditions used in the case of styrene-butadiene copolymers. There is some indication, however, that polybutadiene crosslinks under conditions used to form chloropolymer shells.

EXAMPLE X

Chlorination of Black Toner

The black toner of Example VIII (4 grams) prepared from the copolymer of Example V, 94 percent, 6 percent of Regal 330® carbon black and no CPC was suspended in 40 milliliters of ethanol and added to a blender containing 500 milliliters of water and 0.6 gram of chlorine. After 10 minutes, the toner was filtered, washed and dried. The toner against Xerox Corporation 1075 TM carrier had a triboelectric charge of 20.54 microcoulombs per gram. The toner minimum fix temperature was 230° F. and hot offset temperature was 330° F. The glass transition temperature of the chlorine treated toner increased (from 45.5° C. of the untreated material) to 48.9° C. The chlorinated toner passed the blocking test at 125° F.

EXAMPLE XI

Chlorination of Black Toner

The black toner of Example VIII (10 grams), 94 percent polymer resin, was formulated with 6 percent of Regal 330®, was suspended in 50 milliliters of ethanol, and was added to 500 milliliters of chlorine water containing 0.6 gram of chlorine using a Waring blender. After 10 minutes, the chlorine-water-toner suspension was pH 3. The toner was filtered, washed and dried. The toner showed two glass transition temperatures, one at 52° C. and another at 55° C. The triboelectric charge of this toner was measured against a number of typical xerographic carriers.

| Carrier | Tribo (Microcoulombs per gram) | Percent Toner Concentration |
|---|---|---|
| 70-30 Kynar/PMMA | 2.72 | 2.92 |
| 30-70 Kynar/PMMA | −7.81 | 2.66 |
| 40-60 Kynar/PMMA | −4.55 | 2.44 |
| 10-90 Kynar/PMMA | −13.20 | 2.78 |
| Xerox 1075 TM | 8.28 | 2.87 |
| Xerox 1065 TM | 9.75 | 2.93 |

EXAMPLE XII

Chlorination of Black Toner

A black toner was formulated from 94 percent of suspension polymerized styrene, 22 weight percent of butadiene copolymer of Example I (Tg 37.8° C.) by melt extrusion with 6 percent of Regal 330® carbon black and 2 percent of CPC. After micronization to 8 to 10 micron toner particles, the Tg of the resultant toner was 40.7° C. This toner (5 grams) was suspended in 50 milliliters of ethanol and was added to 250 milliliters of chlorine water prepared by adding chlorine gas (0.7 gram, 200 milliliters) to 800 milliliters of water. The pH increased over 15 minutes from 2.2 to 3.0. After filtration, washing, and vacuum drying, the toner had a Tg of 44.9° C., and passed the blocking tests at 125° F. The minimum fix temperature of the toner increased by 10° F. over that of the untreated (unchlorinated) toner with the same components.

EXAMPLE XIII

Chlorination of Black Toner

A black toner was made with the copolymer of Example IV, 94 percent of polymer resin, and 6 percent of Regal 330® carbon black by melt extrusion followed by micronization. The toner (5 grams) suspended in 50 milliliters of ethanol was added to 250 milliliters of chlorine water at pH 2.2 prepared by adding chlorine gas (200 milliliters, 0.7 gram) to 800 milliliters of water. The pH increased from 2.2 to 2.9 over 15 minutes at which time the toner was isolated by filtration, washed and vacuum dried. The Tg of the toner increased from 45.5° C. to 49.5° C. as a result of chlorine treatment. The chlorine treated toner passed the blocking test at 125° F. The minimum fix temperature of the toner increased to 250° F. from 240° F. after chlorine treatment as compared to toner with no chlorination.

EXAMPLE XIV

Chlorination of Cyan Toner

A cyan toner (5 grams) made with 2 percent of PV Fast Blue and the copolymer resin of Example IV, 98 percent, was suspended in 50 milliliters of ethanol and added to 250 milliliters of chlorine water made with 200 milliliters of chlorine gas (0.7 gram) in 800 milliliters of water. After 15 minutes, the toner was filtered, washed and vacuum dried. Solid area toner images on transparency stock were fused at 275° F. using a Xerox Corporation 5028 TM silicon roll fuser operated at 3.1 inches per second. The projection efficiency of the untreated toner from Example IV was 74.8 percent with a gloss of 93 and a haze of 20.7 percent at an image density of 0.3621. The chlorine treated toner, which was prepared as illustrated in this Example, evidenced a projection efficiency of 70.5 percent with a gloss of 74 and a haze of 26.2 percent at an image density of 0.3644 under the same fusing conditions. These values indicate that the chlorine treatment does not bleach the toner color and after the projection efficiency of the toner. Also, the above prepared chlorine treated toner passed the blocking test at 125° F., and a similar untreated chlorinated toner failed the blocking test at 110° F.

EXAMPLE XV

Chlorine Treatment of Black Toners

A series of anionic styrene-butadiene copolymers, 94 percent or 91 percent, were prepared and fabricated into toner with 6 percent of Regal 330® carbon black with and without 2 percent of cetyl pyridinium chloride. The toners (5 grams) suspended in 50 milliliters of ethanol were added to 250 milliliters of chlorine water in a Waring blender. The chlorine water was prepared by adding 200 milliliters of chlorine gas (0.6 gram) to 800 milliliters of water. After 15 minutes stirring, each toner was isolated by filtration, was washed and then vacuum dried. Physical properties and the fusing properties of the aforementioned chlorine treated toners and untreated chlorine toners with the same components as above are summarized in Table II. Similarly, a Xerox Corporation toner with suspension poly(styrene, 22 weight percent butadiene) copolymer and a Goodyear emulsion styrene butadiene copolymer as toner with 92 percent of copolymer, 2 percent of CPC, and 6 percent of Regal 330® carbon black were treated with chlorine water.

TABLE II

Physical Properties of Styrene Butadiene Polymers and Fusing Characteristics of the Toners Thereof Before and After Chlorine Treatment

| EXAMPLE | Wt. % BD | % 1,2 Vinyl | GPC $M_w/M_n$ | Tg °C. | MFT °F. | HOT °F. | Block Test | Tribo Microcoulombs per gram (% Tc) |
|---|---|---|---|---|---|---|---|---|
| Cl-untreated (anionic polymer) | 34.0 | 89.8 | 32736/19466 | 37.9 | 200 | 256 | fail | 30.1 (2.80) w/o CPC<br>45.3 (3.17) w/2% CPC |
| Cl-treated (anionic polymer) | | | | | 230 | 310 | pass | |
| Cl-untreated (anionic polymer) | 33.2 | 82.5 | 96073/40373 | 35.3 | 205 | 295 | fail | 29.4 (2.73) w/o CPC |

TABLE II-continued

Physical Properties of Styrene Butadiene Polymers and Fusing Characteristics of the Toners Thereof Before and After Chlorine Treatment

| EXAMPLE | Wt. % BD | % 1,2 Vinyl | GPC $M_w/M_n$ | Tg °C. | MFT °F. | HOT °F. | Block Test | Tribo Microcoulombs per gram (% Tc) |
|---|---|---|---|---|---|---|---|---|
| | | | | | | | | 26.8 (2.83) w/CPC |
| Cl-treated (anionic polymer) | | | | 37.5 | 230 | 330+ | pass | 30.8 (2.65) |
| Cl-untreated (anionic polymer) | 28.6 | 86.1 | 32300/20500 | 45.5 | 220 | 290 | fail | 21.1 (2.87) w/o CPC |
| Cl-treated (anionic polymer) | | | | 46.7 | 240 | 290 | pass | 14.4 (3.32) |
| Cl-treated (anionic polymer) | | | | 49.5 | 240 | 295 | pass | 13.6 (3.27) |
| Cl-untreated (anionic polymer) | 23.2 | 78.9 | 62780/35640 | 46.7 | 250 | 325 | fail | 39.9 (3.13) w/CPC |
| Cl-treated (anionic polymer) | | | | 49.9 | 245 | 340 | pass | 20.7 (3.18) |
| Cl-untreated (suspension) | 22.0 | 0 | 108000/11000 | 40.7 | 250 | 290 | fail | |
| Cl-treated (suspension) | | | | 45.0 | 240 | 295 | pass | 20.2 (3.00) |
| Cl-untreated* (Goodyear emulsion) | | | | 50.7 | 260 | 320+ | fail | |
| Cl-treated (Goodyear emulsion) | | | | 53.5 | 275 | 320+ | pass | 28.7 (3.26) |

*Emulsion styrene-butadiene copolymer from Goodyear
BD = butadiene
MFT = minimum fix temperature
HOT = hot offset temperature
Block Test = 125° F.

EXAMPLE XVI

Chlorination of Pilot Plant Scale Black Toner

Anionic polymerized styrene, 32.85 weight percent butadiene copolymer of Example IV and suspension polymerized styrene, 22 weight percent butadiene copolymer of Example I (scale-up) were converted into toner by Banbury melt mixing 92 percent of resin copolymer with 6 percent of Regal 330® carbon black and 2 percent of CPC followed by micronization. After classification to 10 microns, the toners (5 grams) were suspended in 50 milliliters of ethanol and added to chlorine water in a Waring blender. The concentration of diatomic chlorine varied between 158 and 750 ppm. Triboelectric properties and fusing results for the chlorine treated and untreated toner are summarized in Table III.

TABLE III

Chlorination and Fusing Evaluation of Low Melt Encapsulated and Nonencapsulated Toners of Example XVI

| Sample | ppm chlorine water[a] | Tribo microcoulombs per gram (% TC)[b] | MFT, °F. Tape | MFT, °F. Crease | MFT, °F. HOT |
|---|---|---|---|---|---|
| A[c,d] | 0 | 33.69 (3.15) | 225 | 225 | 320 |
| B | 158 | 24.0 (3.13) | 230 | 230 | 320 |
| C (passes blocking 120° F.) | 240 | 19.3 (3.39) | 250 | 230 | 340 |
| D | 333 | 21.3 (3.19) | 260 | 250 | >400 |
| E | 530 | 21.4 (3.20) | 270 | 260 | >400 |
| F | 750 | 17.7 (3.18) | 300 | 300 | >400 |
| G[c,e] | 240 | 20 (3.20) | 260 | 230 | 300 |
| I[c] | 0 | | 320 | 315 | 390 |

[a]250 milliliters of chlorine water per 5 grams of toner for 20 minutes
[b]against 1075 carrier
[c]toner formulation: 6% of Regal 330 carbon black/2% of CPC
[d]anionic styrene-butadiene copolymer -- Tg, 40° C.; 32.85 wt. % of butadiene; $M_n$ = 40,000
[e]suspension styrene-butadiene copolymer - Tg, 40° C.; 22 wt. % of butadiene; $M_n$ = 15,000

EXAMPLE XVII

"C-Shell" (chlorine treated) Toners Made with Suspension Polymerized Styrene, 22 weight percent Butadiene Copolymer A black toner was prepared comprised of 92 weight percent of the polymer resin of Example I, 6 percent of Regal 330® carbon black and 2 percent of CPC by Banbury melt mixing followed by micronization to about 10 micron toner particles. The toner (150 grams) was suspended in 250 to 300 milliliters of ethanol using a Waring blender, was added to 7,500 milliliters of water adjusted to pH 2.5 with chlorine, and stirred with a mechanical stirrer. After 20 minutes, the toner was filtered, washed, and vacuum dried. The triboelectric properties of the chlorine treated toner, and a similar untreated toner were 32.08 and 30.1 microcoulombs per gram, respectively, at 3.23 and 3.21 percent toner concentration. The minimum fix temperature of the untreated toner was 235° F. and the hot offset temperature was 275° F. The untreated toner failed the blocking test at 110° F. By contrast, the chlorine treated toner with a chloropolymer shell had a minimum fix temperature of 270° F., and a hot offset temperature of 330° F. The chlorine treated toner passed the blocking test at 130° F.

EXAMPLE XVIII

Cyan Toner Made with Blended Suspension Styrene 22, weight percent Butadiene Copolymer (Example I) and Anionic Styrene, 28.5 weight percent Butadiene Copolymer (Example V)

Two cyan toners were made with 2 percent of PV Fast Blue and polymers, 98 percent, obtained in Examples I and IV, respectively, by melt mixing followed by micronization. The toners (150 grams) were individually suspended in 250 to 300 milliliters of ethanol and were added to 7,500 milliliters of chlorine water adjusted to pH 2.3 to 2.4 with chlorine. Stirring was accomplished using a mechanical stirrer. After 20 minutes, the toners were isolated by filtration, washed and vacuum dried.

The minimum fix temperature of the cyan Example I toner was 270° F. and the hot offset temperature was 340° F. The minimum fix temperature of the cyan Example V toner was 260° F. and the hot offset temperature was 310° F. Both the aforementioned chlorine treated toners passed the blocking test at 125° F. Chlorine untreated similar toners failed the blocking test at 110° F.

EXAMPLE XIX

Glass Transition Temperature of Shell Polymers

To determine the glass transition temperatures (Tg) of chloropolymer shells selected for the toners of the present invention, styrene-butadiene copolymers, and polybutadiene diol ($M_w$ 6,200) available from Scientific Polymer Products (cat. no. 364), about 0.9 to about 2 grams dissolved in 30 weight percent of methylene chloride were treated with chlorine water containing at least 1.1 molar equivalents of chlorine. The change in Tg with complete, 100 percent in most instances, chlorination is contained in Table IV and indicates that a chloropolymer shell (C-shell) formed on the surface of the toner particles. The high Tg chlorinated shell material as compared to the unchlorinated shell is believed to be primarily responsible for the blocking performance and the robustness of the toner shells.

TABLE IV

Glass Transition Temperatures (Tg °C.) of Chloropolymer Shell Material

| Resin | Tg °C. |
|---|---|
| Anionic Styrene, 28.5 Weight Percent of Butadiene Copolymer | 45.5 |
| Exhaustively Chlorinated Anionic Styrene, 28.5 Weight Percent of Butadiene Copolymer | 107 |
| Suspension Styrene, 22 Weight Percent of Butadiene Copolymer | 37 |
| Exhaustively Chlorinated Suspension Styrene, 22 Weight Percent of Butadiene Copolymer | 100 |
| Polybutadiene Diol | <25 |
| Exhaustively Chlorinated Polybutadiene Diol | 61 |

EXAMPLE XX

Preparation of Encapsulated Low Melt Toner Particles

A 1 liter beverage bottle with 800 milliliters of water was equipped with a rubber septum and then degassed using a vacuum pump. Chlorine gas (200 milliliters) was introduced via syringe. The pH of the resultant solution was 2.2. The low melt toner particles of Example II (16 grams) suspended in ethanol (40 milliliters) was added to the chlorine water in a Waring blender with mild stirring for 15 minutes. The pH of the chlorine water was then 3.0. The toner was isolated by filtration, washed with ethanol and vacuum dried. The glass transition temperature of the resultant toner was 45° C. compared with 40° C. for the untreated toner of Example II. The minimum fix temperature of the toner containing 6 percent of Regal 330® carbon black, 92 percent of resin, and 2 percent of cetyl pyridinium chloride charge control additive was 240° F. and the hot offset temperature was 295° F. as measured in Example II at 3.3 inches per second using a Xerox Corporation 5028 TM silicone roll fuser. The untreated toner of Example II fused at 250° F. and the hot offset temperature was 290° F. The chlorine treated toner passed the blocking test at 125° F. The untreated toner aggregated at less than 110° F. and thus failed the blocking test.

EXAMPLE XXI

Encapsulated Low Melt Magnetic Toner

A magnetic toner composition was prepared by melt blending followed by mechanical attrition containing 84 percent by weight of the low melt polymer of Example I, and 16 percent by weight of the magnetite Mapico Black®. Thereafter, the toner composition was jetted and classified resulting in toner particles with an average volume diameter of about 8 to 12 microns as measured by a Coulter Counter. The low melt magnetic toner particles were encapsulated by reaction with chlorine gas by the procedure as described in Example III to afford a nonblocking low melt magnetic toner composition suitable for use in magnetic ink character recognition applications, for example bank check identification code printing. A similar toner composition was prepared with the exception that it contained 74 percent by weight of the low melt polymer of Example I, 16 percent by weight of the Mapico Black®, and 10 percent by weight of Regal 330® carbon black; and 2 percent of a charge enhancing additive of TP 302® (Nachem/Hodogaya). Following chlorine treatment as in Example III, the aforementioned toner particles were classified in a Donaldson Model B classifier for the purpose of removing fine particles, that is those with a volume median diameter of less than about 4 microns.

Developer compositions were then prepared by admixing, respectively, 2.5 and 3.5 parts by weight of the above prepared toner compositions with 97.5 parts and 96.5 parts by weight of a carrier comprised of a steel core with a polymer mixture thereover containing 70 percent by weight of Kynar® a polyvinylidene fluoride, and 30 percent by weight of polymethyl methacrylate; the coating weight being about 0.9 percent. The positive triboelectric charging value of the toners as determined in the known Faraday Cage apparatus was about +20 microcoulombs per gram.

Positively charged toners were also prepared by repeating the above procedure for the preparation of magnetic toner containing a charge additive with the exception that there was included therein 2 percent by weight of the charge enhancing additive cetyl pyridinium chloride, instead of TP 302®, and 6 percent by weight of carbon black particles.

Images were then developed using the aforementioned prepared developer compositions of the present invention with a positive charge additive in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate Makrolon®, reference U.S. Pat. No. 4,265,990, the disclosure of which is totally incorporated herein by reference; and there resulted images of excellent quality with no background deposits and of high resolution for an extended number of imaging cycles exceeding, it is believed, about 75,000 imaging cycles.

Other toner compositions were prepared by repeating the above processes, thus the toner compositions described in the following examples were prepared by melt mixing, followed by mechanical attrition, jetting, classification and then surface halogenation in accordance with the aforementioned process. The positive triboelectric charging values of these toner compositions as determined in the known Faraday Cage apparatus were from about 15 to about 21 microcoulombs per gram.

EXAMPLE XXII

Cyan Toner

The polymer (50 grams), 96 percent, of Example I with 2 percent by weight of PV Fast Blue pigment and 2 percent by weight of cetyl pyridinium chloride charge control agent was melt mixed in a Brabender Plastigraph for 30 minutes at 70° C. and then 30 minutes at 130° C. The resultant toner was jetted into toner, and then surface halogenated with chlorine gas in a fluidizer bed reactor and combined with Xerox Corporation 1075 TM carrier (steel coated 1.25 weight percent, with polyvinyl fluoride) at 3.3 weight percent of toner concentration. A tribocharge value of 21 microcoulombs per gram with 2.98 percent of toner concentration was measured with a standard Faraday Cage blow-off apparatus. Images were developed on Hammermill laser printer paper and Xerox Corporation transparency stock. The DSC glass transition temperature was 45° C. The minimum fix temperature was 260° F. and the hot offset temperature was 320° F. determined with a Xerox Corporation 5028 TM silicon roll fuser operated at 3.1 inches per second. The blocking properties were excellent (greater than 130° F.), that is, no blocking occurred throughout the blocking evaluation. Excellent fused images suited to transparency projection were obtained on a transparency between 265° and 330° F. There was no visible offset of toner to the fuser roll at roll temperatures less than 335° F. Optimal projection efficiency was obtained by fusing at approximately 310° F. A gloss number of 50 at 310° F. fuser set temperature was measured with a 75 degree gloss meter on Hammermill laser paper. The untreated toner had a gloss of 50 at 260° F. fuser set temperature on Hammermill laser paper, using a 75 degree glass meter, however, this toner failed the blocking test at 110° F.

EXAMPLE XXIII

Magenta Toner

The polymer (50 grams), 93.5 percent, of Example I with 5 percent by weight of Hostaperm Pink E pigment and 1.5 percent by weight of potassium tetraphenyl borate charge control agent was melt mixed in a Brabender Plastigraph for 30 minutes at 70° C. and then 30 minutes at 130° C. The resultant plastic was jetted into toner particles and combined with Xerox Corporation 1075 TM carrier at 3.3 weight percent of toner concentration. The toner was treated with chlorine water as in Example VI. A tribocharge value of −30 microcoulombs per gram with 3.35 percent of toner concentration was measured with a standard Faraday Cage blow-off apparatus. The minimum fix temperature was 260° F. The blocking properties were excellent, that is the toner did not agglomerate at temperatures less than 130° F. The pigment dispersion was satisfactory. The projection efficiency and gloss values measured were comparable to those of Example VI. A gloss value 50 was achieved at 310° F. on Hammermill laser paper using a 75 degree glass meter. Projectable fused images on transparency stock were obtained between 265° and 333° F.

The aforementioned toner particles were then surface halogenated with chlorine gas in a fluidized bed reactor as described in Example XXII to afford encapsulated low melt toner particles that were combined with Xerox Corporation 1075 TM carrier at 3.3 weight percent of toner concentration. A tribocharge value of 30 microcoulombs per gram with 3.04 percent of toner concentration was measured with a standard Faraday Cage blow-off apparatus. The blocking properties were excellent, that is, no blocking occurred throughout the blocking evaluation up to 130° F. Excellent pigment dispersion was achieved, and improved transparency projection efficiency was observed with toner images fused at 270° F. and greater. The micronization of the toners included a classification thereafter by known methods, such as in a Donaldson Classifier.

Other modifications of the present invention may occur to those skilled in the art subsequent to a review of the present application, and these modifications are intended to be included within the scope of the present invention.

What is claimed is:

1. A toner composition comprising surface halogenated toner particles, said toner particles each comprising a core of a low melt resin and pigment particles, and a protective shell formed over said core, said protective shell being formed by reacting a surface portion of said low melt resin with a halogen.

2. A toner composition in accordance with claim 1 wherein the low melt resin has the formula $(A—B)_n$ wherein A represents a polymer segment of a first monomer, B represents a polymer segment of a second monomer, and n is at least 1 and represents the number of A and B segments.

3. A toner composition in accordance with claim 2 wherein n is a number of from about 2 to about 100.

4. A toner composition in accordance with claim 2 wherein from about 1 to about 100 A segments are present.

5. A toner composition in accordance with claim 2 wherein from about 1 to about 100 B segments are present.

6. A toner composition in accordance with claim 2 wherein the A segments are comprised of a polystyrene.

7. A toner composition in accordance with claim 2 wherein the B segments are comprised of a polybutadiene.

8. A toner composition in accordance with claim 2 wherein the low melt resin polymer is poly(styrene-1,2-butadiene).

9. A toner composition in accordance with claim 2 wherein the low melt resin polymer is poly(styrene-1,4-butadiene).

10. A toner composition in accordance with claim 2 wherein the resin polymer's dispersity ratio $M_w/M_n$ is from about 1 to about 15.

11. A toner composition in accordance with claim 2 wherein the pigment particles are selected from the group consisting of carbon black, magnetites, and mixtures thereof.

12. A toner composition in accordance with claim 2 wherein the pigment particles are selected from the group consisting of red, blue, green, brown, cyan, magenta, yellow, and mixtures thereof.

13. A toner composition in accordance with claim 2 wherein the low melt toner resin is present in an amount of from about 70 to about 90 percent by weight.

14. A toner composition in accordance with claim 2 wherein pigment particles are present in an amount of from about 2 to about 20 percent by weight.

15. A toner composition in accordance with claim 2 containing charge enhancing additives.

16. A toner composition in accordance with claim 15 wherein the charge enhancing additives are selected from the group consisting of alkyl pyridinium halides, organic sulfates, organic bisulfates, organic sulfonates, distearyl dimethyl ammonium methyl sulfate, distearyl dimethyl ammonium bisulfate, cetyl pyridinium lakesk, polyvinyl pyridine, treated carbon blacks, tetraphenyl borate salts, phosphonium salts, nigrosine, metal-salicylate salts, metal complexes, polystryene-polyethylene oxide block copolymer salt complexes, poly(dimethyl amino methyl methacrylate), metal azo dye complexes, organo-aluminum salts, Aerosils® and zinc stearate.

17. A toner composition in accordance with claim 15 wherein the charge enhancing additive is present in an amount of from about 0.1 to about 10 percent by weight.

18. A toner composition in accordance with claim 2 containing microcrystalline waxes.

19. A toner composition in accordance with claim 2 wherein the triboelectric charge on the toner is from about a positive or negative 5 to about 35 microcoulombs per gram.

20. A developer composition comprised of the toner composition of claim 2, and carrier particles.

21. A developer composition in accordance with claim 20 wherein the carrier particles are comprised of a core of steel, iron, or ferrites.

22. A developer composition in accordance with claim 20 wherein the carrier particles include thereover a polymeric coating.

23. A method for developing images which comprises the formation of an electrostatic latent image on a photoconductive member; developing the resulting image with the toner composition of claim 2; subsequently transferring the developed image to a suitable substrate; and thereafter permanently affixing the image thereto.

24. A method of imaging in accordance with claim 23 wherein the toner composition maintains triboelectrical charging characteristics for one million copies.

25. A surface halogenated toner comprised of a low melt toner resin polymer of claim 2 wherein A is polystyrene, and B is polybutadiene.

26. A surface halogenated toner comprised of a low melt toner resin polymer of claim 2 wherein B is atactic and syndiotactic poly 1,2-butadiene.

27. A surface halogenated toner comprised of a low melt toner resin polymer of claim 2 wherein B is cis and trans poly 1,4-butadiene.

28. A surface halogenated toner comprised of a low melt toner resin polymer of claim 2 wherein B is partially hydrogenated cis, trans 1,4-polybutadiene or 1,2-vinyl polybutadiene.

29. A surface halogenated toner comprised of a low melt toner resin polymer of claim 2 wherein B is polyisoprene or partially hydrogenated polyisoprene.

30. A toner in accordance with claim 2 wherein the dispersity ratio $M_w/M_n$ of the low melt resin is from about 1 to about 15.

31. A toner composition in accordance with claim 1 wherein low melt resin has a number average molecular weight of from about 3,000 to about 100,000.

32. A toner composition in accordance with claim 1 containing charge enhancing additives.

33. A toner composition in accordance with claim 32 wherein the charge enhancing additives are selected from the group consisting of alkyl pyridinium halides, organic sulfates, organic bisulfates, organic sulfonates, distearyl dimethyl ammonium methyl sulfate, distearyl dimethyl ammonium bisulfate, cetyl pyridinium lakes, polyvinyl pyridine, treated carbon blacks, tetraphenyl borate salts, phosphonium salts, nigrosine, metal-salicylate salts, metal complexes, polystryene-polyethylene oxide block copolymer salt complexes, poly(dimethyl amino methyl methacrylate), metal azo dye complexes, organo-aluminum salts, Aerosils® and zinc stearate.

34. A toner composition in accordance with claim 1 with a fusing temperature of between about 200° F. to about 370° F.

35. A method for developing images which comprises the formation of an electrostatic latent image on a photoconductive member; developing the resulting image with the toner composition of claim 1; subsequently transferring the developed image to a suitable substrate; and thereafter permanently affixing the image thereto.

36. A developer composition comprised of the toner composition of claim 1, and carrier particles.

37. A developer composition in accordance with claim 36 wherein the carrier particles are comprised of ferrites, steel, or an iron powder.

38. A toner in accordance with claim 1 containing surface additives.

39. A toner in accordance with claim 38 wherein the surface additive is selected from the group consisting of metal oxides, hydrophobic colloidal silicas, hydrophilic colloidal silicas, and metal salts of fatty acids.

40. A toner composition in accordance with claim 1 wherein the resin has a glass transition temperature of between from about 20° C. to about 75° C.

* * * * *